US009040861B2

(12) United States Patent
Park

(10) Patent No.: US 9,040,861 B2
(45) Date of Patent: May 26, 2015

(54) ARC EXTINGUISHING APPARATUS FOR RING MAIN UNIT

(71) Applicant: LSIS CO., LTD., Anyang-Si, Gyeonggi-Do (KR)

(72) Inventor: Woo Jin Park, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 148 days.

(21) Appl. No.: 13/711,450

(22) Filed: Dec. 11, 2012

(65) Prior Publication Data

US 2013/0153538 A1 Jun. 20, 2013

(30) Foreign Application Priority Data

Dec. 20, 2011 (KR) ..... 10-2011-0138575

(51) Int. Cl.

| | |
|---|---|
| ***H01H 9/44*** | (2006.01) |
| ***H01H 33/00*** | (2006.01) |
| ***H01H 9/30*** | (2006.01) |
| ***H01H 33/02*** | (2006.01) |
| ***H01H 33/08*** | (2006.01) |

(Continued)

(52) U.S. Cl.

CPC ..... *H01H 33/182* (2013.01); *H01H 1/365* (2013.01); *H01H 33/022* (2013.01); *H01H 33/14* (2013.01); *H01H 33/7084* (2013.01)

(58) Field of Classification Search

CPC ..... H01H 1/54; H01H 9/443; H01H 33/18; H01H 33/124; H01H 33/182; H01H 1/42; H01H 1/2041

USPC ..... 218/26, 23, 29, 30, 37, 50, 51, 53, 85, 218/113, 67, 43; 200/19.18, 43.07, 50.34, 200/50.39, 51.06; 361/604, 621

See application file for complete search history.

(56) References Cited

U.S. PATENT DOCUMENTS 3,646,284 A * 2/1972 Bokshorn et al. ..... 200/48 R
4,417,111 A * 11/1983 Kishi et al. ..... 218/44

(Continued)

FOREIGN PATENT DOCUMENTS

| | | |
|---|---|---|
| CN | 1034633 | 8/1989 |
| EP | 0485306 | 5/1992 |

(Continued)

OTHER PUBLICATIONS

Translation of EP 0485306 B1 from Google Patents—original, pulublished Oct. 18, 1995.*

(Continued)

*Primary Examiner* — Truc Nguyen
*Assistant Examiner* — William Bolton
(74) *Attorney, Agent, or Firm* — Lee, Hong, Degerman, Kang & Waimey

(57) ABSTRACT

An arc extinguishing apparatus for a ring main unit includes: a housing; a plurality of fixed contactor assemblies fixed to be protruded toward the center in the housing and formed by inserting a permanent magnet for arc extinguishing by a magnetic force between a pair of main circuit fixed contacts; a plurality of earthing fixed contactors fixed to be protruded toward the center in the housing and installed to be spaced apart from the fixed contactor assemblies at a predetermined angle; a 3-phases common rotational shaft installed to be rotatable at the center of the housing; and a rotatable movable contactor assembly having a plurality of puffer guide plate sections having openings with a narrow opening width to accelerate the velocity of flow of insulating gas to extinguish arc by blowing it, and rotatable to a circuit closing position, an earthing position, and a circuit opening position.

7 Claims, 10 Drawing Sheets

(51) Int. Cl.

| | |
|---|---|
| ***H01H 33/18*** | (2006.01) |
| ***H01H 33/70*** | (2006.01) |
| *H01H 1/36* | (2006.01) |
| *H01H 33/14* | (2006.01) |

(56) References Cited

U.S. PATENT DOCUMENTS

| | | | | |
|---|---|---|---|---|
| 4,803,319 | A | 2/1989 | Bernard et al. | |
| 5,153,399 | A * | 10/1992 | Schaffer et al. | 218/63 |
| 8,575,508 | B2 * | 11/2013 | Kashiwagi et al. | 218/23 |
| 2007/0252667 | A1 * | 11/2007 | Zhou et al. | 335/16 |

FOREIGN PATENT DOCUMENTS

| | | | | |
|---|---|---|---|---|
| EP | 0485306 | A1 * | 5/1992 | H01H 1/54 |
| EP | 0874380 | | 10/1998 | |

OTHER PUBLICATIONS

European Patent Office Application Serial No. 12195692.4, Search Report dated Apr. 2, 2013, 4 pages.

The State Intellectual Property Office of the People's Republic of China Application Serial No. 201210558672.5, Office Action dated Dec. 18, 2014, 9 pages.

* cited by examiner

ARC EXTINGUISHING APPARATUS FOR RING MAIN UNIT

CROSS-REFERENCE TO RELATED APPLICATION

Pursuant to 35 U.S.C. §119(a), this application claims the benefit of earlier filing date and right of priority to Korean Patent Application No. 10-2011-0138575, filed on Dec. 20, 2011, the contents of which are hereby incorporated by reference herein in its entirety.

BACKGROUND OF THE INVENTION

1. Field of the Invention

The present disclosure relates to a ring main unit (so called abbreviated as RMU), and particularly, to an arc extinguishing apparatus for a ring main unit.

2. Background of the Invention

A multi-circuit switchgear so called as the ring main unit is the electric power device for using to branch the electric power from an electric power line (that is an electric power cable) laid under the ground and distribute it to an electric consumer such as a building on the ground or to divide the electric power.

The ring main unit includes an outer case charged with an arc-extinguishing gas for extinguishing an arc therein, incoming power lines for Alternating Current (abbreviated as AC hereinafter) 3 phases (in other words 3 poles) led into the outer case from the underground electric power line, outgoing power lines for a plurality of branch lines connected from the outer case to a plurality of electric loads (or consumers), and a switch mechanism for electrically switching to a connecting position that connects the incoming power lines with the outgoing power line for a branch line, earthing position for earthing (or grounding) the power lines or separation position that separates the incoming power lines from the outgoing power line.

An example of the ring main unit according to the related art will be described with reference to FIGS. 1 to 7.

First, a configuration of an arc-extinguishing apparatus of the ring main unit according to an example of the related art will be described.

The disclosed related art cites the disclosure of U.S. Pat. No. 4,803,319, and a more detailed configuration and operation may be referred to the publication of U.S. Pat. No. 4,803,319.

The ring main unit according to an embodiment of the related art is configured to include an outer case 1, a first bushing 10*a*, a second bushing 10*b*, a first fixed contact 2, a permanent magnet 7, a second fixed contact 3, a first bus bar 4, a second bus bar 5, an upper insulator 6*a*, a lower insulator 6*b*, a rotational shaft 8, a movable contact 9, a support frame 12, and an insulating gas 11.

In FIG. 1, reference numeral 15 denotes an arc generated between contacts when the movable contact 9 is separated from the first fixed contact 2 and the second fixed contact 3 while an electric current flows, and reference numeral 16 denotes a magnetic field generated in the vicinity of the permanent magnet 7 by the permanent magnet 7.

In FIG. 2, reference numeral 13 denotes an insulating partition wall for electrically insulating electric power circuit for each phase in order to prevent short circuit between phases.

Also, reference numeral 15*a* in FIGS. 4 and 6 designates a high temperature and high pressure arc vapor moving as ambient air is heated by the arc 15.

The outer case 1 determines an external appearance of the ring main unit and is provided as a means for accommodating or supporting the configuring components of the ring main unit. As shown in FIGS. 1 and 2, the outer case 1 is made of a metal whose vertical section is a rectangular shape or a circular shape.

The first bushing 10*a* is a terminal unit fixedly installed on an upper portion of the outer case 1. The first bushing 10*a* has an electrical conductor member therein and is formed by molding an electrical insulating material on the outside thereof such that incoming power lines of respective AC phases such as an R phase, an S phase, and a T phase led into the outer case 1 from the underground power line. As shown in FIG. 2, three first bushings 10*a* may be provided to correspond to the three AC phases, respectively.

The second bushing 10*b* is a terminal member fixedly installed on a lower portion of the outer case 1, to which outgoing power lines for a plurality of branch lines connected from the outer case 1 to the electric loads (or consumers) are connected. Like the first bushing 10*a*, the second bushing 10*b* includes an electric conductor member therein and is formed by molding an electric insulating material on the outside thereof. Three second bushings 10*b* may be provided to correspond to three AC phases in each of the branch circuit.

The first fixed contact 2 is a fixed contact portion electrically connected to the first bushing 10*a* through the first bus bar 4 and is configured by an electric conductor blade.

As shown in FIG. 5, the permanent magnet 7 is inserted into an end portion open to both sides, that is, into an accommodation recess portion formed in both end portions of the first fixed contact 2 and supported therein, and a cover 14 may be installed to prevent the permanent magnet 7 from being released downwardly.

As shown in FIG. 2, three first fixed contacts 2 may be provided to correspond to the three AC phases, respectively.

The permanent magnet 7 is a means fixedly installed in the end portion of the first fixed contact 2 and for applying a magnet field 16 to extinguish the arc 15.

The second fixed contact 3 is an electric load side fixed contact portion electrically connected to the second bushing 10*b* through the second bus bar 5, and is configured by an electrical conductor blade. As shown in FIG. 2, three second fixed contacts 3 may be provided to correspond to three AC phases, respectively.

The first bus bar 4 is an electrical conductor that electrically connects the first fixed contact 2 to the first bushing 10*a*. For example, the first bus bar 4 may be made of a copper material and configured as a thin wide bar.

The second bus bar 5 is an electrical conductor that electrically connects the second fixed contact 3 to the second bushing 10*b*. For example, the second bus bar 5 may be made of a copper material and configured as a thin wide bar.

The upper insulator 6*a* is an insulating support member made of an electrically insulating material and supporting the first bus bar 4 such that it is electrically insulated from the support frame 12.

The lower insulator 6*b* is an electrically insulating support member made of an electrically insulating material and supporting the second bus bar 5 such that it is electrically insulated from the support frame 12.

The movable contact 9 is configured by an electrical conductor and supported to be rotatable by the rotational shaft 8. The movable contact 9 is a rotatable unit that is rotatable to a circuit closing position (or an ON position) in which the movable contact 9 is in contact with the first fixed contact 2 and the second fixed contact 3 to switch the 3-phases electric power circuit between the electric power source side and the electric load side of each branch circuit into a closed circuit state, or to a circuit opening position (or an OFF position) in which the movable contact 9 is separated from the first fixed contact 2 and the second fixed contact 3 to switch the 3-phases electric power circuit into an open circuit state.

As shown in FIG. 2, the three movable contacts 9 are commonly supported by the rotational shaft 8 so as to be rotated, and three movable contacts 9 may be provided to correspond to the 3-phases electric power circuits.

The rotational shaft 8 is a driving unit for supporting and driving the movable contact 9 to the circuit opening position or the circuit closing position. The rotational shaft 8 is connected to an electric motor (not shown) or a manual driving source (not shown) and rotated in a clockwise direction or counterclockwise direction.

The support frame 12, which is a means for supporting the upper insulator 6*a*, the lower insulator 6*b*, and the rotational shaft 8, is fixedly installed in the outer case 1.

The operation of the ring main unit according to an example of the related art configured as described above will be described with reference to FIGS. 1 to 7.

First, an operation from the circuit opening position (OFF position) as can be seen in FIGS. 1 to 4 to the circuit closing position as can be seen in FIG. 3 will be described.

When the rotational shaft 8 is rotated by an electric motor (not shown) or a manual driving source (not shown) in the clockwise direction, the movable contact 9 goes into a position in which it is in contact with the first fixed contact 2 and the second fixed contact 3 according to driving of the rotational shaft 8.

Thus, an underground power line for the electric power source side electrically connected to the first fixed contact 2 through the first bus bar 4, the first bushing 10*a*, and an incoming power line for each phase (not shown) is electrically connected to the electric load side power line of a branch circuit electrically connected through the movable contact 9, the second fixed contact 3, the second bus bar 5, the second bushing 10*b*, and an outgoing electric power line for each phase (not shown), and thus, electric power may be supplied from the underground power line to the branch circuit.

Next, an operation from the circuit closing position (or an ON position) as can be seen in FIG. 3 to the circuit closing position (or an OFF position) as can be seen in FIGS. 1 to 4 will be described.

When the rotational shaft 8 is rotated by an electric motor (not shown) or a manual driving source (not shown) in the counterclockwise direction, the movable contact 9 goes into a position in which it is separated from the first fixed contact 2 and the second fixed contact 3 according to driving of the rotational shaft 8.

Thus, the underground power line for the electrical power source side electrically connected to the first fixed contact 2 through the first bus bar 4, the first pushing 10*a*, and an incoming power line of each phase (not shown) is electrically separated from the electric power line of the electric load side of the branch circuit electrically connected through the movable contact 9, the second fixed contact 3, the second bus bar 5, the second bushing 10*b*, and an outgoing power line for each phase (not shown), and the electric power supply to the branch circuit from the underground power line is interrupted.

In the case of the interrupting operation, the arc 15 occurs between the first fixed contact 2 and the movable contact 9, and the high temperature and high pressure arc vapor 15*a* is generated in the vicinity of the arc 15. At this time, as can be seen in FIGS. 4 and 5, electromagnetic force F as shown in FIG. 4 is generated by a current I and the magnetic field 16 according to Fleming's left hand rule. Such electromagnetic force F acts to push the arc 15 between the first fixed contact 2 and the movable contact 9, so the arc 15 between the first fixed contact 2 and the movable contact 9 is pushed out to become extinct.

However, as the circuit closing operation or the circuit opening operation is frequently performed, the high temperature and high pressure arc vapor 15*a* is attached to the first fixed contact 2 and the upper insulator 6*a* to contaminate and damage the first fixed contact 2 and the upper insulator 6*a* and cause insulation breakdown between the first bar 4 and the support frame 12. Also, as the density of the high temperature and high pressure arc vapor 15*a* in the insulating gas 11 is increased, insulation performance of the insulating gas 11 and electrical insulation properties between the outer case 1 and the insulating gas 11 are degraded, and in the case of circuit opening operation, electrical insulation properties between the first fixed contact 2 and the second fixed contact 3 and insulation properties among the R, S, and T phases are degraded.

SUMMARY OF THE INVENTION

Therefore, an aspect of the detailed description is to provide an arc extinguishing apparatus for a ring main unit capable of quickly extinguishing an arc by resolving shortage of arc extinguishing performance based on only magnetic force as in the related art by an accelerating and blowing effect of an insulating gas, thereby improving arc extinguishing performance.

To achieve these and other advantages and in accordance with the purpose of this specification, as embodied and broadly described herein, an arc extinguishing apparatus for a ring main unit, includes: a housing in which an insulating gas is charged; a plurality of fixed contactor assemblies for a power circuit fixed to be protruded toward the center in the housing and formed by inserting a permanent magnet for arc extinguishing by a magnetic force between a pair of main circuit fixed contacts; a plurality of earthing fixed contactors fixed to be protruded toward the center in the housing and installed to be spaced apart from the fixed contactor assemblies for a power circuit at a predetermined angle; a 3-phase common rotational shaft installed to be rotatable at the center of the housing; and a rotatable movable contactor assembly formed to extend from the rotational shaft, having a plurality of puffer guide plate sections having openings with a narrow opening width to accelerate the velocity of flow of insulating gas to extinguish arc by blowing it, and rotatable to a circuit closing position in which the rotatable movable contactor assembly is in contact with a main circuit fixed contact of the fixed contactor assembly for a power circuit, an earthing position in which the rotatable movable contactor assembly is in contact with the earthing fixed contactor, and a circuit opening position in which the rotatable movable contactor assembly is separated from the main circuit fixed contact and separated from the earthing fixed contactor, according to a rotation or the rotational shaft.

According to an aspect of the present invention, the movable contactor assembly may include a movable contactor provided to extend in a diameter direction from the rotational shaft, having a plurality of movable contacts installed to be in contact with the main circuit fixed contacts or the earthing fixed contactors interposed therebetween and spaced apart from one another in a facing manner, and provided to correspond to the three phases.

According to another aspect of the present invention, the movable contactor assembly further may include a pair of insulating partition wall portions facing each other by phases and spaced apart by a predetermined first distance in order to electrically insulate the movable contactor while allowing the earthing fixed contactor to pass therethrough.

The puffer guide plate section allowing the fixed contactor assembly for a power circuit to enter when the movable contactor assembly operates to a circuit closing position may have an opening with a width narrower than the first distance of the insulating partition wall portion in order to accelerate the velocity of flow of the insulating gas.

According to still another aspect of the present invention, each of the fixed contactor assemblies for a power circuit may include an insulating cover having a width larger than that of the main circuit fixed contact and made of an electrical insulating material, and the puffer guide plate section allowing the fixed contactor assembly for a power circuit to enter when the movable contactor assembly operates to a circuit closing position may have an opening having a width which is large at an end portion thereof to allow the insulating cover to pass therethrough and becomes narrower toward the rotational shaft to allow the main circuit fixed contact to pass therethrough.

According to still another aspect of the present invention, the insulating cover may include a cutaway portion formed to be trimmed slantingly to have a width reduced toward the permanent magnet, so as to freely pass through the opening of the puffer guide plate section when the movable contactor assembly operates to the circuit closing position or the circuit opening position.

According to still another aspect of the present invention, the puffer guide plate section may further include: a nozzle section formed to be bent at a right angle from the corner of the opening of the puffer guide plate section to accelerate an inflow speed or an outflow speed of the insulating gas.

According to still another aspect of the present invention, the rotational shaft may be divided into three rotational shaft sections so as to be separated or assembled to correspond to three phases.

According to still another aspect of the present invention, each of the rotational shaft sections may include a plurality of recess and protrusion portions formed to be protruded and depressed on both end portions thereof in a diameter direction, in order to allow the movable contactor assemblies of three phases to be easily separated or assembled.

According to still another aspect of the present invention, the movable contactor assemblies of three phases and the rotational shaft sections may be configured as a single assembly.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

The foregoing objects and a configuration and an operational effect of the present invention will become more apparent from the following detailed description of the configuration and operation of an arc extinguishing apparatus for a ring main unit according to preferred embodiments of the present invention when taken in conjunction with FIGS. 8 to 15.

Figure 8:
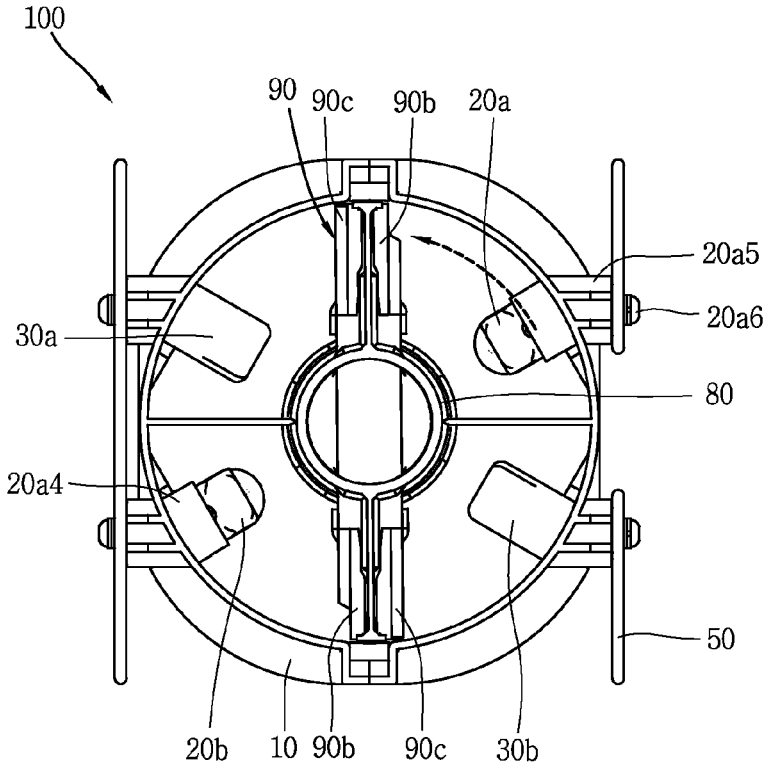
FIG. 8 is a front view illustrating an operational state at a circuit opening position in a configuration of a major part of a ring main unit having an arc extinguishing apparatus according to a preferred embodiment of the present invention.
Figure 9:
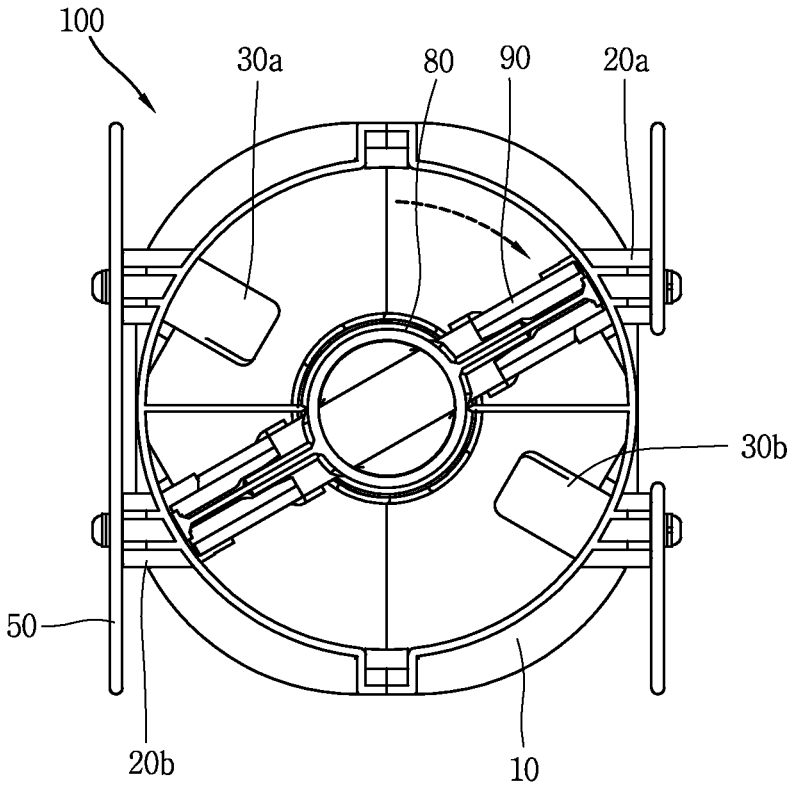
FIG. 9 is a front view illustrating an operational state at a circuit closing position in a configuration of a major part of a ring main unit having an arc extinguishing apparatus according to a preferred embodiment of the present invention.

As can be seen in FIGS. 8 and 9, an arc extinguishing apparatus 100 for a ring main unit according to a preferred embodiment of the present invention includes a housing 10, a plurality of contactor assemblies 20*a* and 20*b* for an electric power circuit (abbreviated as circuit hereinafter), a plurality of earthing fixed contactors 30*a* and 30*b*, a rotational shaft 80, and a movable contactor assembly 90.

The housing 10 is a means for accommodating and supporting constituent components of the arc extinguishing apparatus 100. Preferably, the housing 10 may be formed by molding an artificial resin material having electrical insulation properties and may have a tubular shape as in the illustrated embodiment or may be variously modified to have a shape of a square pillar such that that a section thereof has a quadrangular shape.

Figure 1:
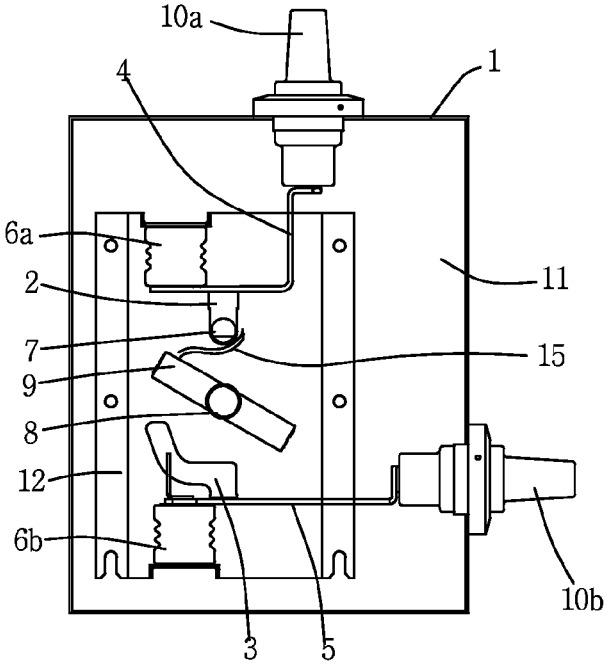
FIG. 1 RELATED ART
FIG. 1 is a side sectional view taken in a vertical direction to illustrate a configuration of a ring main unit according to an example of the related art.
Figure 2:
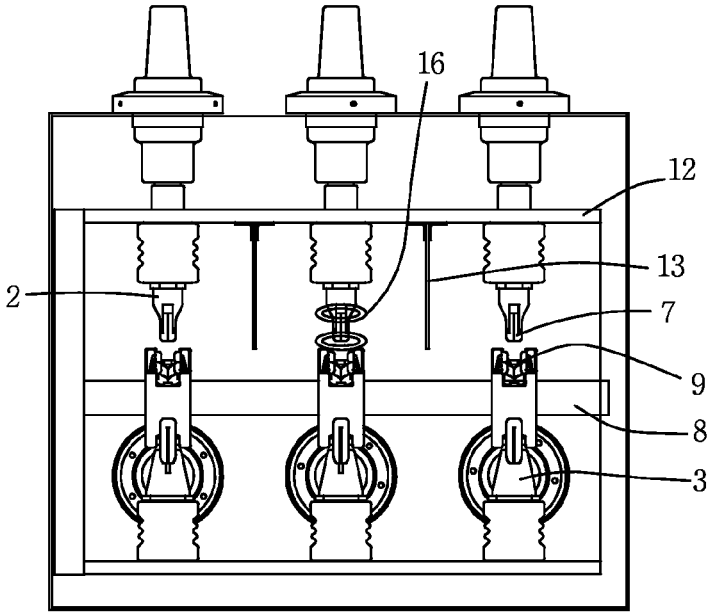
FIG. 2 RELATED ART
FIG. 2 is a front sectional view taken in the vertical direction of the ring main unit according to an example of the related art.
Figure 3:
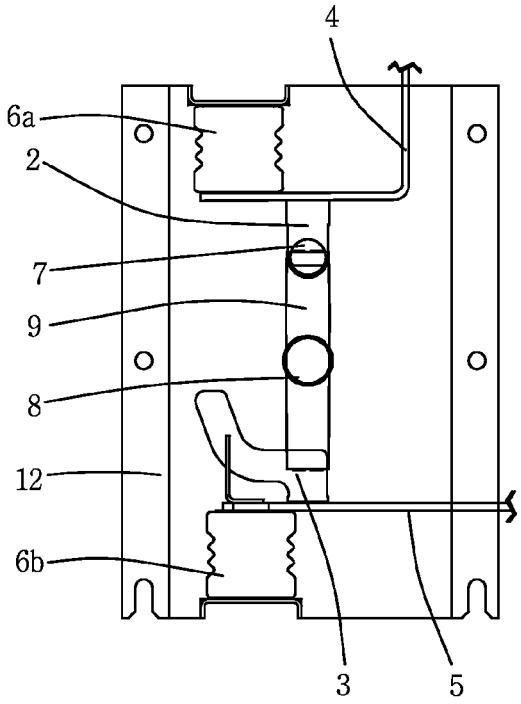
FIG. 3 RELATED ART
FIG. 3 is a view illustrating an operational state of a major part of the ring main unit in a circuit closing position according to an example of the related art.

In the ring main unit having the arc extinguishing apparatus 100 according to an embodiment of the present invention, an outer case, such as the outer case 1 illustrated in FIGS. 1 and 2, is provided to the exterior of the housing 10, and an insulating gas may be charged between the housing 10 and the outer case.

The plurality of fixed contactor assemblies 20*a* and 20*b* for the circuit are fixed to be protruded toward a center of the housing 10 in the housing 10. Among the plurality of fixed contactor assemblies 20*a* and 20*b* for the circuit, the upper fixed contactor assembly 20*a* may be electrically connected to an electric power source side of the circuit, and the lower fixed contactor assembly 20*b* may be electrically connected to an electric load side of the circuit.

The upper fixed contactor assembly 20*a* and the lower fixed contactor assembly 20*b* may be formed to have the same configuration, and according to a preferred embodiment, a permanent magnet (See 20*a*2 in FIG. 11) may be installed in the upper fixed contactor assembly 20*a*. Three upper fixed contactor assemblies 20*a* and three lower fixed contactor assemblies 20*b* may be provided to correspond to three AC phases of R, S, and T.

Figure 11:
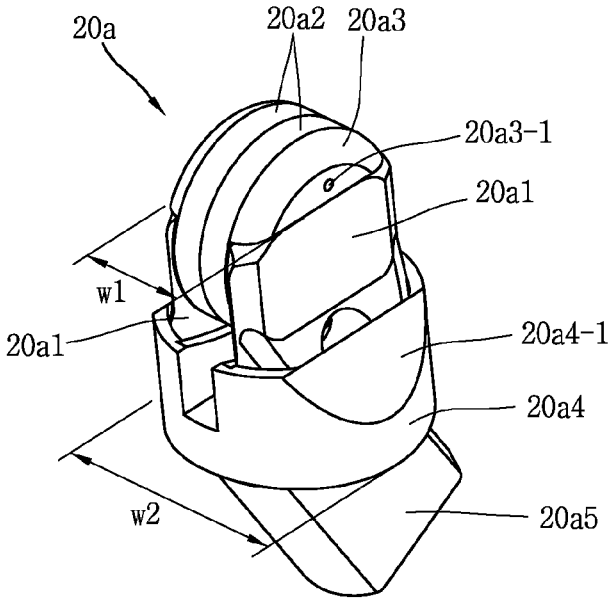
FIG. 11 is a perspective view of a fixed contactor assembly of the arc extinguishing apparatus of the ring main unit according to a preferred embodiment of the present invention.
Figure 12:
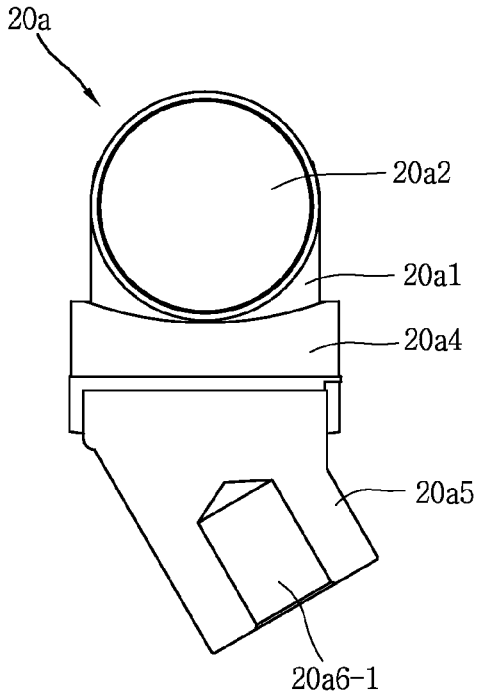
FIG. 12 is a vertical sectional view of the fixed contactor assembly of FIG. 11.
Figure 13:
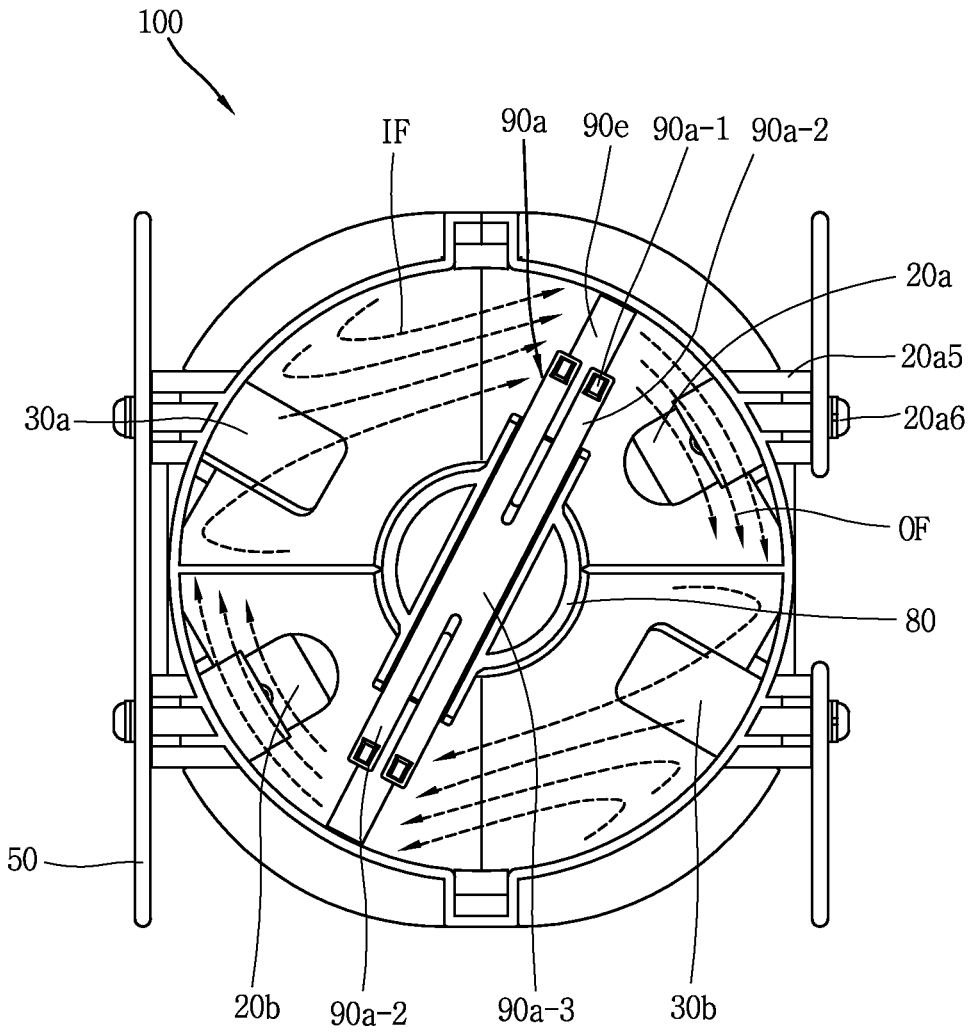
FIG. 13 is a vertical sectional view of the arc extinguishing apparatus of the ring main unit in which a blowing phenomenon occurs when an insulating gas flows in and flows out according to a preferred embodiment of the present invention.

A detailed configuration of the fixed contactor assembly 20*a* will be described with reference to FIGS. 11 to 13 representatively showing the detailed configuration of the fixed contactor as a perspective view and a sectional view, respectively.

As can be seen, the upper fixed contactor assembly 20*a* may include a pair of main circuit fixed contacts 20*a*1, permanent magnets 20*a*2, magnet covers 20*a*3, an insulating cover 20*a*4, an extending conductor 20*a*5, and a connection screw 20*a*6.

As can be seen in FIGS. 11 and 12, the pair of main circuit fixed contacts 20*a*1 are configured as electrical conductor blades installed to be spaced apart from one another in order to allow the permanent magnets 20*a*2 for arc extinguishing to be installed therebetween. The pair of main circuit fixed contacts 20*a*1 may be electrically connected to an electric power source side of the circuit.

Figure 4:
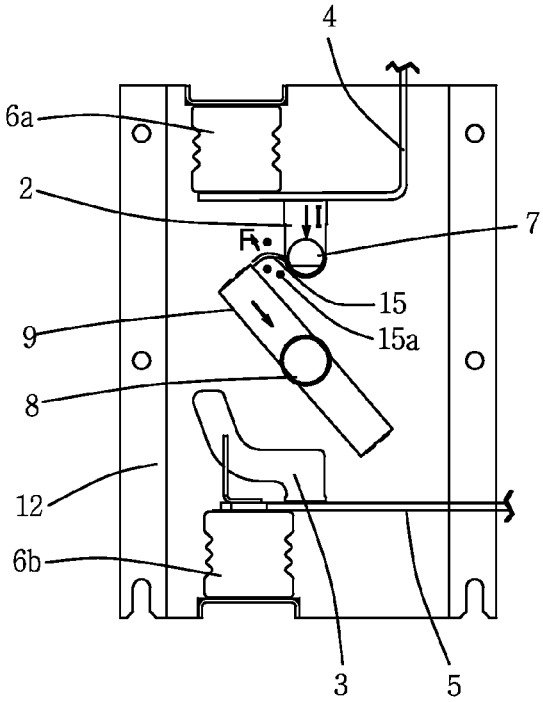
FIG. 4 RELATED ART
FIG. 4 is a view illustrating an operational state of the major part of the ring main unit at an initial stage of a circuit opening position according to an example of the related art.
Figure 5:
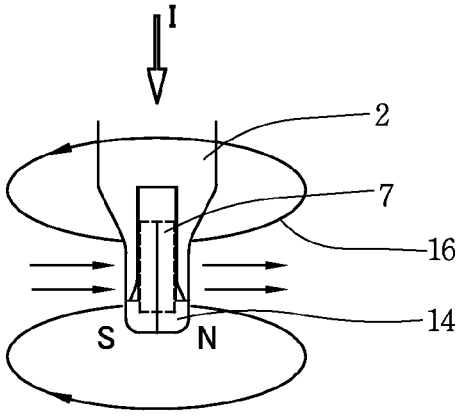
FIG. 5 RELATED ART
FIG. 5 is a partially enlarged view illustrating a configuration of an end portion of a first fixed contact of the ring main unit and a magnetic field formed in the surroundings thereof according to an example of the related art.
Figure 6:
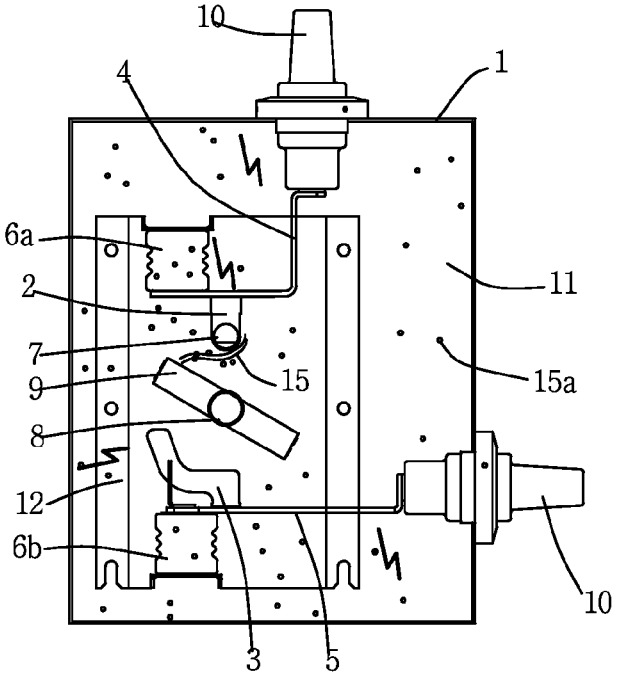
FIG. 6 RELATED ART
FIG. 6 is a side sectional view taken in the vertical direction illustrating an arc and a insulation breakdown phenomenon due to a generation of arc vapor at a circuit opening completion position in the ring main unit according to an example of the related art.

The permanent magnet 20*a*2 are configured as a pair of disk shaped permanent magnets and inserted to be installed between the pair of main circuit fixed contacts 20*a*1 for arc extinguishing. Like the permanent magnet 7 of the related art illustrated in FIGS. 4 and 5 as described above, the permanent magnets 20*a*2 act to push out the arc to an outer side by magnetic force.

The magnet covers 20*a*3 are configured as a pair and fixedly installed in end portions of the pair of main circuit fixed contacts 20*a*1 in order to support end portions of the permanent magnet 20*a*2 from both sides. Also, pin holes 20*a*3-1 are formed to pass through both of the magnet covers 20*a*3, and a pin (not shown) is inserted to pass through the upper portions of the permanent magnets 20*a*2 through the corresponding pin holes 20*a*3-1 to support the end portions of the permanent magnet 20*a*2 such that they are prevented from leaving.

The insulating cover 20*a*4 is made of an electrical insulating material, and has a recess portion allowing base portions of the pair of main circuit fixed contacts 20*a*1 to be inserted and supported therein. The base portions of the pair of main circuit fixed contacts 20*a*1 are inserted to be supported in the recess portion, and the insulating cover 20*a*4 shields to protect an area of the housing 10 against arc on which the pair of main circuit fixed contacts 20*a*1 is installed.

Also, as can be seen from FIG. 11, a width w2 of the insulating cover 20*a*4 is wider than a width w1 of the pair of main circuit fixed contacts 20*a*1.

Also, as can be seen from FIG. 11, the insulating cover 20*a*4 includes a cutaway portion 20*a*4-1 formed to be trimmed slantingly to have a width reduced toward the permanent magnets 20*a*2, so as to freely pass through an opening of a puffer guide plate section 90*b* as described hereinafter when the movable contactor assembly 90 operates to a circuit closing position or a circuit opening position.

The extending conductor 20*a*5 is an electrical conductor unit extending from the pair of main circuit fixed contacts 20*a*1 to the outside of the housing 10. The extending conductor 20*a*5 is mechanically and electrically connected to a bus bar 50 as an external conductive path formed by an electrical conductor of FIGS. 8 and 9. Here, the bus bar 50 is a means for providing a conduction path by the three phases R, S, and T common to the arc extinguishing apparatus 100 of each of a plurality of branch circuits, and thus, three bus bars may be configured. The bus bar 50 may be installed to extend generally in a horizontal direction in an accommodation space between the housing 10 and the outer case as described above.

As can be seen from FIG. 13 or 12, the connection screw 20*a*6 is a means for mechanically or electrically connecting the bus bar 50 and the extending conductor 20*a*5. A leg portion of the connection screw 20*a*6 is inserted into a connection screw hole 20*a*6-1 in FIG. 12 through the bus bar 50.

As can be seen from FIGS. 8 and 9, the plurality of earthing fixed contactors 30*a* and 30*b* are configured as electrical conductor blades fixed to be protruded toward the center in the housing 10, and are installed to be spaced apart at a predetermined angle from the fixed contactor assemblies 20*a* and 20*b*.

As can be seen from FIGS. 8 and 9, the rotational shaft 80 common to three phases is rotatably installed at the center of the housing 10. According to a preferred aspect of the present invention, the rotational shaft is configured as a shaft formed by molding an artificial resin material having electrical insulating properties.

Figure 10:
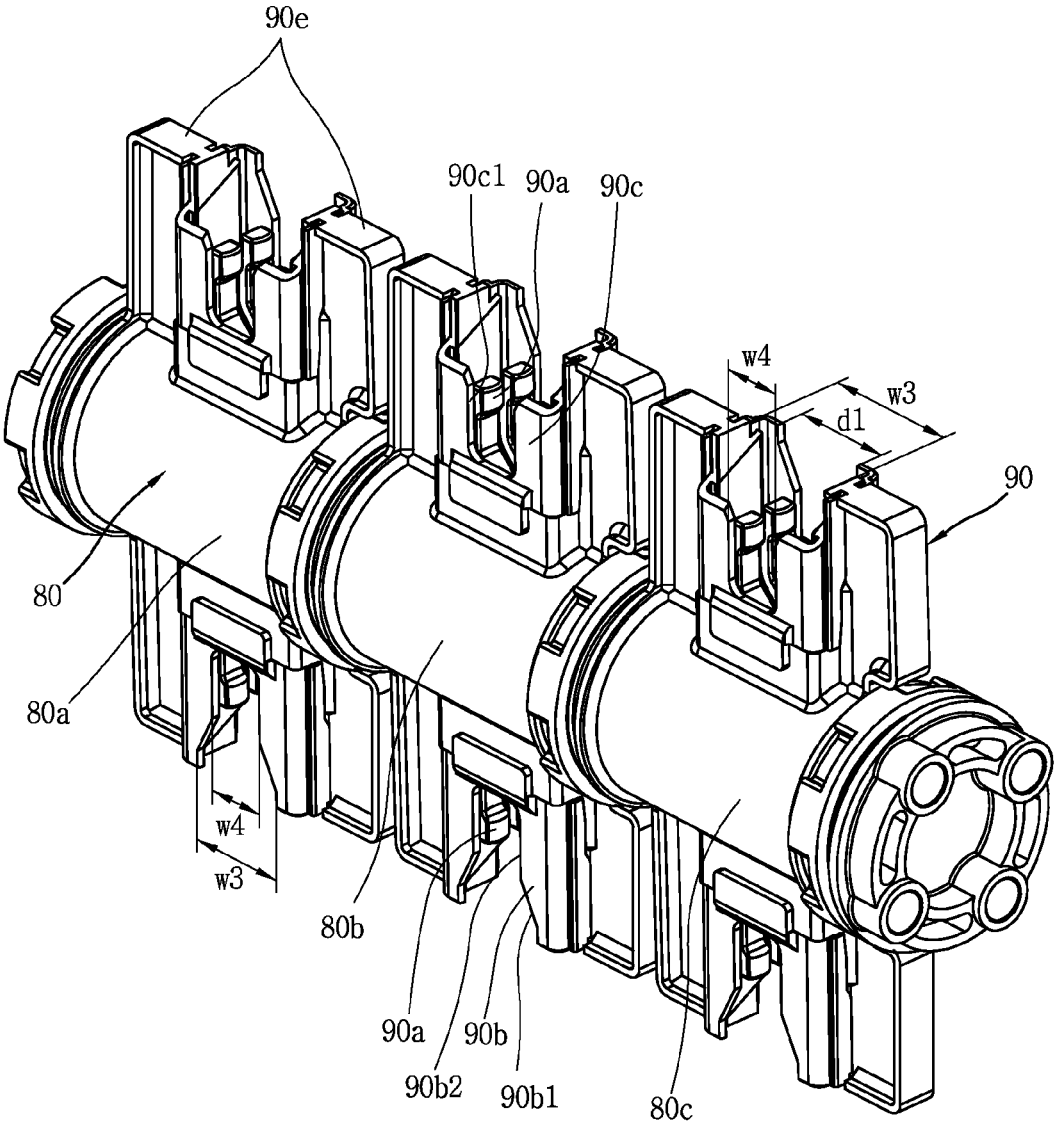
FIG. 10 is a perspective view illustrating a configuration of a movable contactor assembly and a rotational shaft of a 3-phases arc extinguishing apparatus of the ring main unit according to a preferred embodiment of the present invention.
Figure 14:
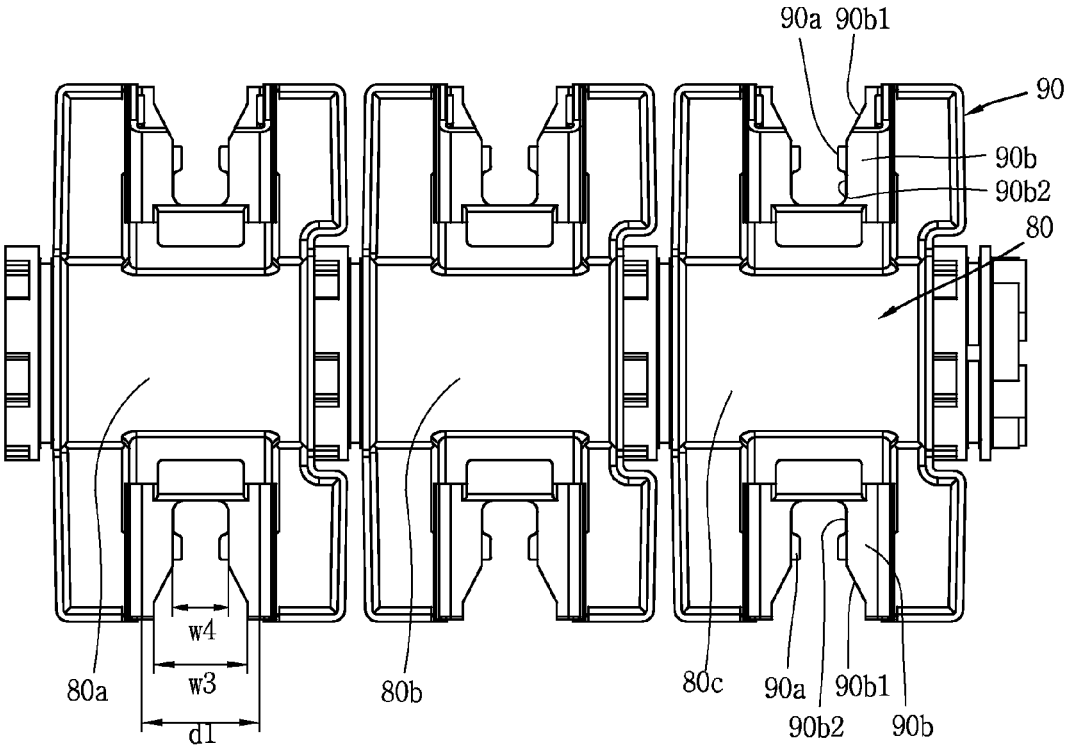
FIG. 14 is a front view illustrating a configuration of a 3-phases movable contactor assembly and the rotational shaft in the 3-phases arc extinguishing apparatus of the ring main unit according to another preferred embodiment of the present invention.
Figure 15:
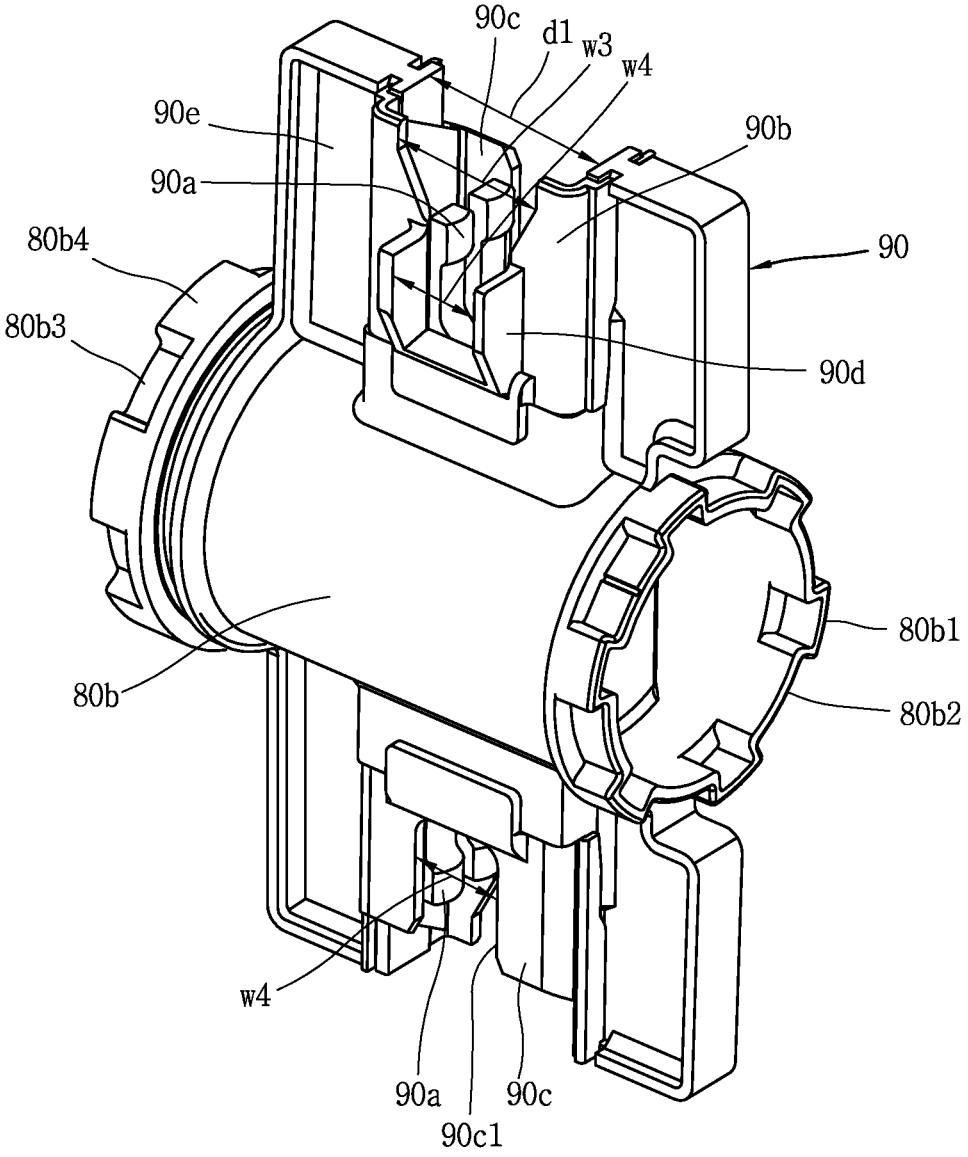
FIG. 15 is a perspective view illustrating a configuration of movable contactor assembly and the rotational shaft for one-phase in the arc extinguishing apparatus of the ring main unit according to another preferred embodiment of the present invention.

As can be seen from FIG. 15, 10 or 14, according to a preferred embodiment of the present invention, the rotational shaft 80 is divided into three rotational shaft sections 80*a*, 80*b*, and 80*c* that may be separated or assembled to correspond to the three AC phases of R, S, and T.

Also, as can be seen from FIG. 15 representatively showing a configuration of the middle S-phase rotational shaft section 80*b* among the three rotational shaft sections 80*a*, 80*b*, and 80*c*, each of the rotational shaft sections 80*a*, 80*b*, and 80*c* has a plurality of protrusion and recess assembling portions formed to be protruded and concave in a diameter direction at both end portions thereof, such that the 3-phases movable contactor assemblies can be easily separated or assembled. Here, the protrusion and recess assembling portion includes first protrusion and recess portions 80*b*1 and 80*b*2 formed at a right end portion and second protrusion and recess portions 80*b*3 and 80*b*4 formed at a left end portion.

Assembling of the rotational shaft sections 80*a*, 80*b*, and 80*c* may be performed by inserting the second protrusion and recess portions 80*b*3 and 80*b*4 to an outer side of the first protrusion and recess assembling portions 80*b*1 and 80*b*2 between rotational shaft sections of adjacent phase. Namely, the rotational shaft sections 80*a*, 80*b*, and 80*c* are assembled such that protruded portions of the second protrusion and recess assembling portions 80*b*3 and 80*b*4 are positioned in an outer side of protruded portions of the first protrusion and recess assembling portions 80*b*1 and 80*b*2, and depressed portions of the second protrusion and recess assembling portions 80*b*3 and 80*b*4 are positioned in an outer side of depressed portions of the first protrusion and recess assembling portions 80*b*1 and 80*b*2.

As can be seen from FIGS. 8 to 10 and FIGS. 13 to 15, the movable contactor assembly 90 includes a plurality of movable contactors 90*a* and a plurality of puffer guide plate sections.

The plurality of movable contactors 90*a* are formed to extend in a diameter direction from the rotational shaft 80, and provided to correspond to three AC phases of R, S, and T.

In detail, as can be seen from FIG. 13, the movable contactor 90*a* for each phase is configured as an electrical conductor having two pairs of extending portions 90*a*-2 formed to pass through the rotational shaft 80 and extend to be symmetrical at both sides in a diameter direction and an intermediate common body portion 90*a*-3. One movable contact 90*a*-1 is installed in each extending portion 90*a*-2, and the two pairs of extending portions 90*a*-2 at each side in the diameter direction from the rotational shaft 80 and the movable contacts 90*a*-1 installed on the corresponding extending portions 90*a*-2 are provided to be spaced apart in a facing manner such that the main circuit fixed contact 20*a*1 of the fixed contactor assemblies 20*a* and 20*b* or the earthing fixed contactors 30*a* and 30*b* are interposed to be in contact therebetween. FIG. 13 is a vertical sectional view showing only a single movable contactor 90*a* for a phase, in which only a pair among two pairs of extending portions 90*a*-2 and movable contacts 90*a*-1 at each side is shown respectively.

Also, as can be seen from FIG. 13, the movable contactor 90*a* may be rotatable to a circuit closing position (in other words an ON position) in which the movable contactor 90*a* is in contact with the main circuit fixed contact 20*a*1 of the fixed contactor assemblies 20*a* and 20*b* for a power circuit, an earthing position (in other words a ground position) in which the movable contactor 90*a* is in contact with the earthing fixed contactors 30*a* and 30*b*, and a circuit opening position in which the movable contactor 90*a* is separated from the main circuit fixed contact 20*a*1 and separated from the earthing fixed contactors 30*a* and 30*b*, according to a rotation or the rotational shaft 80.

As can be seen from FIG. 10, 14, or 15, the movable contactor assembly 90 further includes an insulating partition wall portion 90*e*. Here, the insulating partition wall portion 90*e* is provided to insulate the movable contactors 90*a* from one another which are basically provided correspondingly for each phase. Also, in order to allow the fixed contactor assemblies 20*a* and 20*b* or the earthing fixed contactors 30*a* and 30*b* to pass therethrough, a pair of insulating partition wall portion 90*e* are provided to face each other by phases and spaced apart by a predetermined first distance d1.

As can be seen from FIG. 10, 14, or 15, the plurality of puffer guide plate sections include a plurality of first puffer guide plate sections 90*b* and a plurality of second puffer guide plate sections 90*c*.

The plurality of first puffer guide plate sections 90*b* and the plurality of second puffer guide plate sections 90*c* are formed to extend from the rotational shaft 80 and have an opening portions having a narrow opening width, namely, a sloped opening portion 90*b*1, and a first straight line opening portion 90*b*2 or a second straight line opening portion 90*c*1 in order to accelerate the velocity of flow of the insulating gas IF to extinguish an arc by blowing it.

In particular, in order to allow the insulating cover 20*a*4 having a width w2 greater than a width w1 of the pair of main circuit fixed contacts 20*a*1 of the fixed contactor assemblies 20*a* and 20*b* to pass therethrough, the first puffer guide plate section 90*b* includes the sloped opening portion 90*b*1 having a width w3 at an end portion thereof wider than the width w2 of the insulating cover 20*a*4 and having the width narrowed toward the rotational shaft 80 to allow the main circuit fixed contact 20*a*1 to pass therethrough, and the first straight line opening portion 90*b*2 formed to extend linearly toward the rotational shaft 80 from the sloped opening portion 90*b*1. Here, a width w4 of the first straight line opening portion 90*b*2 is greater than the width w1 of the main circuit fixed contact 20*a*1.

Also, the plurality of second puffer guide plate section 90*c* has the second straight line opening portion 90*c*1 having the width w4 narrower than the first distance d1 of the insulating partition wall portion 90*a* to accelerate the velocity of flow of the insulating gas (IF in FIG. 13). Here, since the width w4 of the second straight line opening portion 90*c*1 is narrower than the width w2 of the insulating cover of the fixed contactor assemblies 20*a* and 20*b*, the insulating cover 20*a*4 cannot pass through the second straight line opening portion 90*c*1 and the insulating gas (IF in FIG. 13) only is accelerated while passing through the second straight line opening portion 90*c*1.

Comparison of the sizes of the widths may be expressed by Equation (1) shown below.

$$w1<w4<w2<w3<d1 \quad (1)$$

Here, w1 is the width of the main circuit fixed contact 20*a*1, w4 is the width of the second straight line opening portion 90*c*1 of the second puffer guide plate section 90*c*, w2 is the width of the insulating cover 20*a*4 of the fixed contactor assemblies 20*a* and 20*b*, w3 is the width of an end portion having an opening with the widest opening width in the first puffer guide plate section 90*b*, and d1 is the first distance as a distance between the pair of insulating partition wall portion 903.

Thus, when the movable contactor assembly 90 operates to the circuit closing position, only the plurality of first puffer guide plate sections 90*b* may allow the fixed contactor assemblies 20*a* and 20*b* to enter. Namely, when the rotational shaft 80 is rotated in a clockwise direction from the circuit opening position (an OFF position) illustrated in FIG. 8, the fixed contactor assemblies 20*a* and 20*b* enter the sloped opening portion 90*b*1 and the first straight line opening portion 90*b*2 of the first puffer guide plate section 90*b*, thus allowing for the entering of the fixed contactor assemblies 20*a* and 20*b*. In FIG. 8, the direction of the arrow in the dotted line indicates a rotational direction of the movable contactor assembly 90 operating to the circuit opening position (the OFF position).

Figure 7:
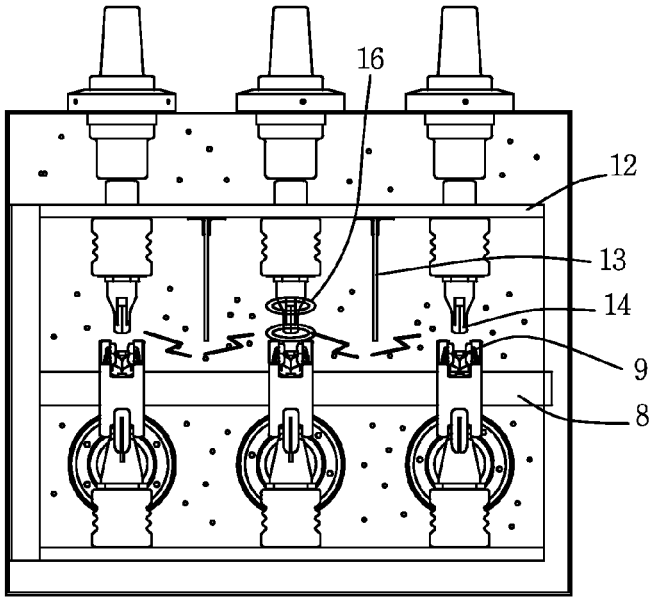
FIG. 7 RELATED ART
FIG. 7 is a front sectional view taken in the vertical direction illustrating an arc and a insulation breakdown phenomenon due to a generation of arc vapor at the circuit opening completion position in the ring main unit according to an example of the related art.

Although not shown, a width of the earthing fixed contactors 30*a* and 30*b* may be equal to the width w1 of the main circuit fixed contact 20*a*1 according to a preferred embodiment of the present invention. Thus, as the rotational shaft 80 is rotated in a counterclockwise direction as shown in FIG. 7, the earthing fixed contactors 30*a* and 30*b* pass through the second straight line opening portion 90*c*1 of the second puffer guide plate section 90*c* to be in the earthing position in which they are in contact with the movable contact (See 90*a*-1 in FIG. 13), and as the rotational shaft 80 is rotated in the clockwise direction from the earthing position, the earthing fixed contactors 30*a* and 30*b* may be in the circuit opening position as shown in FIG. 8 in which the movable contact (See 90*a*-1 in FIG. 13) is separated from the earthing fixed contactors 30*a* and 30*b*.

As can be seen from FIG. 15, according to a preferred embodiment of the present invention, the pair of first puffer guide plate sections 90*b* may further include a nozzle section 90*d* extending upon being bent from the corner of the opening portion of each of the first puffer guide plate section 90*b* to accelerate an inflow speed or an outflow speed of the insulating gas.

According to an embodiment illustrated in FIG. 8 or 15, the first puffer guide plate section 90*b* may be installed in one side of an upper portion of the movable contactor assembly 90, the second puffer guide plate section 90*c* may be installed in the other side of the upper portion of the movable contactor assembly 90, the second puffer guide plate section 90*c* may be installed in one side of a lower portion of the movable contactor assembly 90, and the first puffer guide plate section 90*b* may be installed in the other side of the lower portion of the movable contactor assembly 90. The purpose of the configuration in which the first puffer guide plate sections 90*b* and the second puffer guide plate sections 90*c* are alternately installed in one side and the other side of the upper and lower portions of the movable contactor assembly 90 is because the first puffer guide plate section 90*b* having the sloped opening portion 90*b*1 with the opening width w3 greater than the width w2 of the insulating cover 20*a*4 among the fixed contactor assemblies 20*a* and 20*b* is required only in one side in which the fixed contactor assemblies 20*a* and 20*b* enter and exit.

However, in order to simplify the configuration of the movable contactor assembly 90, all the puffer guide plate sections in one side and the other side of the upper and lower portions of the movable contactor assembly 90 may be configured as the first puffer guide plate sections 90*b* as illustrated in FIG. 14.

According to a preferred embodiment of the present invention, the movable contactor assembly 90 including the movable contactor 90*a*, the first puffer guide plate section 90*b*, the second puffer guide plate section 90*c*, the nozzle section 90*d*, and the insulating partition wall portion 90*e*, and the rotational shaft sections 80*a*, 80*b*, and 80*c* may be configured as a single assembly for each phase as illustrated in FIG. 15, and may be integrally formed through molding.

According to the configuration of the assembly of the movable contactor assembly 90 for each phase and the rotational shaft 80, fabrication productivity can be enhanced in fabricating the arc extinguishing apparatus of the ring main unit, and even when a defect or a fault is discovered during fabrication or after being installed in a service location, the corresponding assembly may be replaced to thus obtain effects that the defect can be easily coped with and maintenance is simplified.

Meanwhile, an operation of the arc extinguishing apparatus for a main ring unit according to a preferred embodiment of the present invention configured as described above will be described with reference to FIGS. 8 to 15 and mainly with reference to FIG. 13.

First, an operation from the circuit opening position (in other words the OFF position as illustrated in FIG. 8) to the circuit closing position (in other words the ON position) as illustrated in FIG. 9 in the arc extinguishing apparatus of the ring main unit according to a preferred embodiment of the present invention will be described.

When the rotational shaft 80 is rotated by an electric motor (not shown) or a manual driving source (not shown) in a clockwise direction, the movable contactor assembly 90 is in a position in which it is in contact with the fixed contactor assemblies 20*a* and 20*b* according to the driving of the rotational shaft 80. Namely, the main circuit fixed contact 20*a*1 of the fixed contactor assemblies 20*a* and 20*b* inserted to be in contact between the two pairs of movable contacts 90*a*-1 installed to be spaced apart from one another in a facing manner in the movable contactor assembly 90.

Thus, an underground electric power line of the electric power source side electrically connected to the fixed contactor assemblies 20*a* and 20*b* through the bus bar 50 and incoming electric power lines by phases (not shown) are electrically connected to the electric power line of the electric load side of a branch circuit electrically connected through the movable contact 90*a*-1, the fixed contactor assemblies 20*a* and 20*b*, the bus bar 50, and outgoing electric power lines by phases (not shown), so the electric power may be supplied to the branch circuit from the underground electric power line.

Next, an operation from the circuit closing position (in other words the ON position) as illustrated in FIG. 9 to the circuit opening position (in other words the OFF position) as illustrated in FIG. 8 in the arc extinguishing apparatus of the ring main unit according to a preferred embodiment of the present invention will be described.

When the rotational shaft 80 is rotated by power from a driving source such as an opening spring (not shown) or a permanent magnetic actuator (not shown) in a counterclockwise direction, the movable contactor assembly 90 is in a position in which it is separated from the fixed contactor assemblies 20*a* and 20*b* according to the driving of the rotational shaft 80. Namely, the two pairs of movable contacts 90*a*-1 installed to be spaced apart from one another in a facing manner in the movable contactor assembly 90 are separated from the main circuit fixed contact 20*a*1 of the fixed contactor assemblies 20*a* and 20*b*.

At this time, in the case of the operation in the circuit opening position, an arc occurs between the main circuit fixed contact 20*a*1 and the movable contact 90*a*-1 and electromagnetic force generated by the permanent magnet 20*a*2 of the fixed contactor assemblies 20*a* and 20*b* acts to push out the arc between the main circuit fixed contact 20*a*1 and the movable contact 90*a*-1. Also, according to a preferred embodiment of the present invention, the velocity of flow of the insulating gas IF introduced to the openings having the narrow opening width of the plurality of first puffer guide plate sections 90*b* and the plurality of second puffer guide plate sections 90*c*, namely, the sloped opening portion 90*b*1 and the first straight line opening portion 90*b*2 or the second straight line opening portion 90*c*1 can be accelerated by the corresponding openings, and thus, as illustrated in FIG. 13, the arc can be blown to be extinguished by the outflow insulating gas having a fast speed. Thus, since the arc is extinguished by blowing the insulating gas by the velocity of flow accelerated through the narrow openings of the plurality of first puffer guide plate sections 90*b* and the plurality of second puffer guide plate sections 90*c* in addition to the pushing out the arc with the electromagnetic force by the permanent magnet 20*a*2 of the fixed contactor assemblies 20*a* and 20*b*, the arc extinguishing performance can be considerably enhanced in comparison to the related art.

Thus, according to the separation of the movable contact 9*a*-1 and the fixed contactor assemblies 20*a* and 20*b*, the underground electric power line electrically connected to the fixed contactor assemblies 20*a* and 20*b* through the bus bar 50 and the incoming electric power lines by phases (not shown) is electrically separated from the electric power line of the electric load side to the branch circuit electrically connected through the bus bar 50 and the outgoing electric power lines by phases (not shown), so the electric power supply to the branch circuit from the underground electric power line is cut off.

Next, an operation from the circuit closing position (or the ON position) as illustrated in FIG. 9 to an earthing position (not shown) in the arc extinguishing apparatus of the ring main unit according to a preferred embodiment of the present invention will be described.

When the rotational shaft 80 is rotated by an electric motor (not shown) or a manual driving source (not shown) in a counterclockwise direction, the movable contactor assembly 90 is in a position by driving of the rotational shaft 80 in which it is in contact with the earthing fixed contactors 30*a*. Namely, the earthing fixed contacts 30*a* and 30*b* are inserted to be in contact between the two pairs of movable contacts 90*a*-1 installed to be spaced apart from one another in a facing manner in the movable contactor assembly 90.

Thus, the bus bar 50 and the electric load side are earthed.

Since the arc extinguishing apparatus of the ring main unit according to an embodiment of the present invention includes the plurality of puffer guide plate sections having openings with a narrow opening width to accelerate the velocity of flow of the insulating gas to extinguish an arc by blowing it, an arc can be extinguished by blowing it as the insulating gas is accelerated such that the outflow speed is faster than the inflow speed by the corresponding puffer guide plate sections. Therefore, the arc extinguishing performance can be considerably improved in comparison to the related art having the configuration of the arc extinguishing apparatus based only on magnetic force.

In the arc extinguishing apparatus for a ring main unit according to an embodiment of the present invention, since the movable contactors are provided to have a plurality of movable contacts installed to be in contact with the main circuit fixed contacts or the earthing fixed contactors interposed therebetween and spaced apart from each other in a facing manner and disposed to correspond to the three phases, the 3-phases circuits may be opened or closed or earthed according to a rotation position of the rotational shaft.

In the arc extinguishing apparatus for a ring main unit according to an embodiment of the present invention, the movable contactors provided to correspond to the three phases further include the insulating partition wall portions provided to face each other by phases and spaced apart from each other by the predetermined first distance to support the movable contacts while allowing the fixed contactor assemblies or the earthing fixed contactors to pass therethrough, and the puffer guide plate sections allowing the fixed contactor assemblies to enter when the movable contactor assemblies operate to the circuit closing position have the openings with a width narrower than the first distance of the insulating partition wall portions to accelerate the velocity of flow of the insulating gas. Thus, electrical insulation among the 3-phases movable contactors is secured by the insulating partition wall portions, the movable contactors can be supported while allowing the fixed contactor assemblies or the earthing fixed contactors to pass therethrough, and the blow effect that an arc is blown to be extinguished by the insulating gas since the velocity of flow of the insulating gas is accelerated by the opening portions can be obtained.

In the arc extinguishing apparatus for a ring main unit according to an embodiment of the present invention, the fixed contactor assemblies include the insulating cover made of an electrical insulator and having a width greater than that of the main circuit fixed contact, and when the movable contactor assemblies operate to the circuit closing position, the puffer guide plate sections facing the fixed contactor assemblies have the opening portions configured to have a large width at an end portion thereof to allow the insulating cover to pass therethrough and have a width narrowed toward the rotational shaft to allow the main circuit fixed contact to pass therethrough. Thus, since the insulating cover having a large width and the main circuit fixed contact having a narrower width can pass through the opening portions, the contact opening and closing operation can be smoothly performed and the housing area on which the insulating cover is installed can be shielded from an arc so as to be protected.

In the arc extinguishing apparatus for a ring main unit according to an embodiment of the present invention, since the insulating cover includes the cutaway portion formed to be trimmed slantingly such that a width thereof is narrowed toward the permanent magnet, when the movable contactor assemblies operate to the circuit closing position or the circuit opening position, the insulating cover can freely pass through the opening portions of the puffer guide plate sections.

In the arc extinguishing apparatus for a ring main unit according to an embodiment of the present invention, since the puffer guide plate section further includes the nozzle section bent at a right angle from the corner of the opening and extended, a narrow flow passage is formed by the nozzle section, and thus, the speed of the insulating gas flowing in or out while passing through the nozzle section can be accelerated.

In the arc extinguishing apparatus for a ring main unit according to an embodiment of the present invention, the puffer guide plate section is provided in at least one side of the inlet or outlet of the insulating gas in the movable contactor assemblies. Thus, when the puffer guide plate section is provided in the inlet, ambient insulating gas is accelerated to flow in, and when the puffer guide plate section is provided in the outlet, the speed of the insulating gas can be accelerated when flowing out.

In the arc extinguishing apparatus for a ring main unit according to an embodiment of the present invention, the puffer guide plate section is provided in any one of the upper portion and the lower portion of the movable contactor assemblies. Thus, when the puffer guide plate section is provided in the upper portion of the movable contactor assembly, an arc generated between the movable contactors corresponding to the main circuit fixed contact connected to the electric power source side of the circuit can be promptly extinguished, and when puffer guide plate section is provided in the lower portion of the movable contactor assembly, an arc generated between the movable contactors corresponding to the main circuit fixed contact connected to the electric load side of the circuit can be promptly extinguished.

In the arc extinguishing apparatus for a ring main unit according to an embodiment of the present invention, since the rotational shaft is divided into three rotational shaft sections so as to be separated or assembled to correspond to the three phases, fabrication productivity can be enhanced.

In the arc extinguishing apparatus for a ring main unit according to an embodiment of the present invention, since the respective rotational shaft sections have the plurality of recess and protrusion portions formed to be protruded or concaved in a diameter direction at both end portions thereof, the movable contactor assemblies by phases can be easily separated or assembled, enhancing fabrication productivity.

In the arc extinguishing apparatus for a ring main unit according to an embodiment of the present invention, since the movable contactor assembly for each phase and the rotational shaft section are configured as a single assembly, fabrication productivity can be enhance in fabricating the arc extinguishing apparatus of the ring main unit, and even when a defect or a fault is discovered during the fabrication or after being installed in a service location, the corresponding assembly can be easily replaced, thus easily coping with the defect and simplifying maintenance.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An arc extinguishing apparatus for a ring main unit, the apparatus comprising:

a housing in which an insulating gas is charged;

a plurality of fixed contactor assemblies for an electric power circuit fixed to be protruded toward a center in the housing and formed by inserting a permanent magnet for arc extinguishing by a magnetic force between a pair of main circuit fixed contacts;

a plurality of earthing fixed contactors fixed to be protruded toward the center in the housing and installed to be spaced apart from the fixed contactor assemblies at a predetermined angle;

a rotational shaft, which is common to three phases, installed to be rotatable at the center of the housing; and a rotatable movable contactor assembly formed to extend from the rotational shaft, having a plurality of puffer guide plate sections having opening portions with a narrow opening width to accelerate the velocity of flow of insulating gas to extinguish arc by blowing it, and rotatable to a circuit closing position in which the rotatable movable contactor assembly is in contact with the main circuit fixed contacts of the fixed contactor assembly, an earthing position in which the rotatable movable contactor assembly is in contact with the earthing fixed contactor, and a circuit opening position in which the rotatable movable contactor assembly is separated from the main circuit fixed contact and separated from the earthing fixed contactor, according to a rotation or the rotational shaft, wherein each of the fixed contactor assemblies comprises an insulating cover having a width larger than that of the main circuit fixed contact and made of an electrical insulating material, and the puffer guide plate section allowing the fixed contactor assembly for a power circuit to enter when the movable contactor assembly operates to a circuit closing position has an opening portion having a width which is large at an end portion thereof to allow the insulating cover to pass therethrough and becomes narrower toward the rotational shaft to allow the main circuit fixed contact to pass therethrough, wherein the insulating cover comprises a cutaway portion formed to be trimmed slantingly to have a width reduced toward the permanent magnet, so as to freely pass through the opening portion of the puffer guide plate section when the movable contactor assembly operates to the circuit closing position or the circuit opening position.

2. The apparatus according to claim 1, wherein the movable contactor assembly comprises a movable contactor provided to extend in a diameter direction from the rotational shaft, having a plurality of movable contacts installed to be in contact with the main circuit fixed contacts or the earthing fixed contactors interposed therebetween and spaced apart from one another in a facing manner, and provided to correspond to the three phases.

3. The apparatus according to claim 1, wherein the movable contactor assembly further comprises a pair of insulating partition wall portions facing each other, each provided for each phase and spaced apart by a predetermined first distance in order to electrically insulate the movable contactor while allowing the fixed contactor assemblies or the earthing fixed contactors to pass therethrough, and the puffer guide plate section allowing the fixed contactor assembly to enter when the movable contactor assembly operates to a circuit closing position has an opening portion with a width narrower than the first distance of the insulating partition wall portions in order to accelerate the velocity of flow of the insulating gas.

4. The apparatus according to claim 1, wherein the puffer guide plate section further comprises a nozzle section formed to be bent at a right angle and extend from the corner of the opening portion of the puffer guide plate section to accelerate an inflow speed or an outflow speed of the insulating gas.

5. The apparatus according to claim 1, wherein the rotational shaft is divided into three rotational shaft sections so as to be separated or assembled to correspond to three phases.

6. The apparatus according to claim 5, wherein each of the rotational shaft sections comprises a plurality of recess and protrusion portions formed to be protruded and concave on both end portions thereof in a diameter direction, in order to allow the movable contactor assemblies of three phases to be easily separated or assembled.

7. The apparatus according to claim 5, wherein each of the movable contactor assemblies for each phase and each of the rotational shaft section are configured as a single assembly.

* * * * *